US006457839B1

(12) United States Patent
Grandoit

(10) Patent No.: US 6,457,839 B1
(45) Date of Patent: Oct. 1, 2002

(54) ARTIFICIAL ELECTRIC CHRISTMAS TREE

(76) Inventor: Jean J. Grandoit, 600 Hylan Blvd., Apt. B7E, Staten Island, NY (US) 10305-2041

( * ) Notice: Subject to any disclaimer, the term of this patent is extended or adjusted under 35 U.S.C. 154(b) by 0 days.

(21) Appl. No.: 09/775,434

(22) Filed: Feb. 2, 2001

(51) Int. Cl.[7] ..... F21S 6/00
(52) U.S. Cl. ..... 362/123; 362/122
(58) Field of Search ..... 362/123, 122

(56) References Cited

U.S. PATENT DOCUMENTS

| | | | | |
|---|---|---|---|---|
| 3,009,052 A | * | 11/1961 | Holbrook | 174/72 A |
| 3,603,780 A | | 9/1971 | Lu | |
| 3,735,117 A | | 5/1973 | Hunt | |
| 3,985,924 A | | 10/1976 | Pritza | |
| 4,020,201 A | * | 4/1977 | Miller | 248/27.3 |
| 4,068,118 A | * | 1/1978 | Carrington | 362/123 |
| 4,072,857 A | * | 2/1978 | DeVicaris | 362/123 |
| D348,857 S | | 7/1994 | Aldrich | |

* cited by examiner

*Primary Examiner*—Sandra O'Shea
*Assistant Examiner*—Hargobind S. Sawhney

(57) ABSTRACT

An artificial electric christmas tree for making the holiday season safer and more enjoyable. The artificial electric christmas tree includes a tree-like trunk being generally tubular and having a bore extending therethrough and further having a plurality of holes extending through a side wall and along a length thereof; and also includes a tree stand having a support member, a plurality of legs depending therefrom for supporting the tree-like trunk, and fasteners being threaded through said support member for securing the tree-like trunk to said tree stand; and further includes a plurality of electrical outlet members being spacedly disposed in the side wall of the tree-like trunk and being connected to wires; and also includes a plurality of branch-like members each having an end which is securely and removably extended in a respective hole of the tree-like trunk; and further includes a plurality of branch retaining members each being securely disposed in a respective hole and being adapted to receive and retain a respective branch-like member; and also includes strings of light-emitting members each being supported upon a respective branch-like member; and further includes a power cord being connected to the wires of the electrical outlet members for supplying electrical current to the electrical outlet members.

9 Claims, 2 Drawing Sheets

ARTIFICIAL ELECTRIC CHRISTMAS TREE

BACKGROUND OF THE INVENTION

1. Field of the Invention

The present invention relates to an artificial electric tree and more particularly pertains to a new artificial electric christmas tree for making the holiday season safer and more enjoyable.

2. Description of the Prior Art

The use of an artificial electric tree is known in the prior art. More specifically, an artificial electric tree heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,072,857; 3,735,117; 3,985,924; 3,603,780; 4,020,201; and U.S. Pat. No. Des. 348,857.

While these devices fulfill their respective, particular objectives and requirements, the aforementioned patents do not disclose a new artificial electric christmas tree. The inventive device includes a tree-like trunk being generally tubular and having a bore extending therethrough and further having a plurality of holes extending through a side wall and along a length thereof; and also includes a tree stand having a support member, a plurality of legs depending therefrom for supporting the tree-like trunk, and fasteners being threaded through said support member for securing the tree-like trunk to said tree stand; and further includes a plurality of electrical outlet members being spacedly disposed in the side wall of the tree-like trunk and being connected to wires; and also includes a plurality of branch-like members each having an end which is securely and removably extended in a respective hole of the tree-like trunk; and further includes a plurality of branch retaining members each being securely disposed in a respective hole and being adapted to receive and retain a respective branch-like member; and also includes strings of light-emitting members each being supported upon a respective branch-like member; and further includes a power cord being connected to the wires of the electrical outlet members for supplying electrical current to the electrical outlet members.

In these respects, the artificial electric christmas tree according to the present invention substantially departs from the conventional concepts and designs of the prior art, and in so doing provides an apparatus primarily developed for the purpose of making the holiday season safer and more enjoyable.

SUMMARY OF THE INVENTION

In view of the foregoing disadvantages inherent in the known types of artificial electric tree now present in the prior art, the present invention provides a new artificial electric christmas tree construction wherein the same can be utilized for making the holiday season safer and more enjoyable.

The general purpose of the present invention, which will be described subsequently in greater detail, is to provide a new artificial electric christmas tree which has many of the advantages of the artificial electric tree mentioned heretofore and many novel features that result in a new artificial electric christmas tree which is not anticipated, rendered obvious, suggested, or even implied by any of the prior art artificial electric tree, either alone or in any combination thereof.

To attain this, the present invention generally comprises a tree-like trunk being generally tubular and having a bore extending therethrough and further having a plurality of holes extending through a side wall and along a length thereof; and also includes a tree stand having a support member, a plurality of legs depending therefrom for supporting the tree-like trunk, and fasteners being threaded through said support member for securing the tree-like trunk to said tree stand; and further includes a plurality of electrical outlet members being spacedly disposed in the side wall of the tree-like trunk and being connected to wires; and also includes a plurality of branch-like members each having an end which is securely and removably extended in a respective hole of the tree-like trunk; and further includes a plurality of branch retaining members each being securely disposed in a respective hole and being adapted to receive and retain a respective branch-like member; and also includes strings of light-emitting members each being supported upon a respective branch-like member; and further includes a power cord being connected to the wires of the electrical outlet members for supplying electrical current to the electrical outlet members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new artificial electric christmas tree which has many of the advantages of the artificial electric tree mentioned heretofore and many novel features that result in a new artificial electric christmas tree which is not anticipated, rendered obvious, suggested, or even implied by any of the prior art artificial electric tree, either alone or in any combination thereof.

It is another object of the present invention to provide a new artificial electric christmas tree which may be easily and efficiently manufactured and marketed.

It is a further object of the present invention to provide a new artificial electric christmas tree which is of a durable and reliable construction.

An even further object of the present invention is to provide a new artificial electric christmas tree which is susceptible of a low cost of manufacture with regard to both materials and labor, and which accordingly is then susceptible of low prices of sale to the consuming public, thereby making such artificial electric christmas tree economically available to the buying public.

Still yet another object of the present invention is to provide a new artificial electric christmas tree which provides in the apparatuses and methods of the prior art some of the advantages thereof, while simultaneously overcoming some of the disadvantages normally associated therewith.

Still another object of the present invention is to provide a new artificial electric christmas tree for making the holiday season safer and more enjoyable.

Yet another object of the present invention is to provide a new artificial electric christmas tree which includes a tree-like trunk being generally tubular and having a bore extending therethrough and further having a plurality of holes extending through a side wall and along a length thereof; and also includes a tree stand having a support member, a plurality of legs depending therefrom for supporting the tree-like trunk, and fasteners being threaded through said support member for securing the tree-like trunk to said tree stand; and further includes a plurality of electrical outlet members being spacedly disposed in the side wall of the tree-like trunk and being connected to wires; and also includes a plurality of branch-like members each having an end which is securely and removably extended in a respective hole of the tree-like trunk; and further includes a plurality of branch retaining members each being securely disposed in a respective hole and being adapted to receive and retain a respective branch-like member; and also includes strings of light-emitting members each being supported upon a respective branch-like member; and further includes a power cord being connected to the wires of the electrical outlet members for supplying electrical current to the electrical outlet members.

Still yet another object of the present invention is to provide a new artificial electric christmas tree that can be easily and conveniently set up within a very short matter of time.

Even still another object of the present invention is to provide a new artificial electric christmas tree that eliminates overloading anyone electrical outlet in a house or home.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
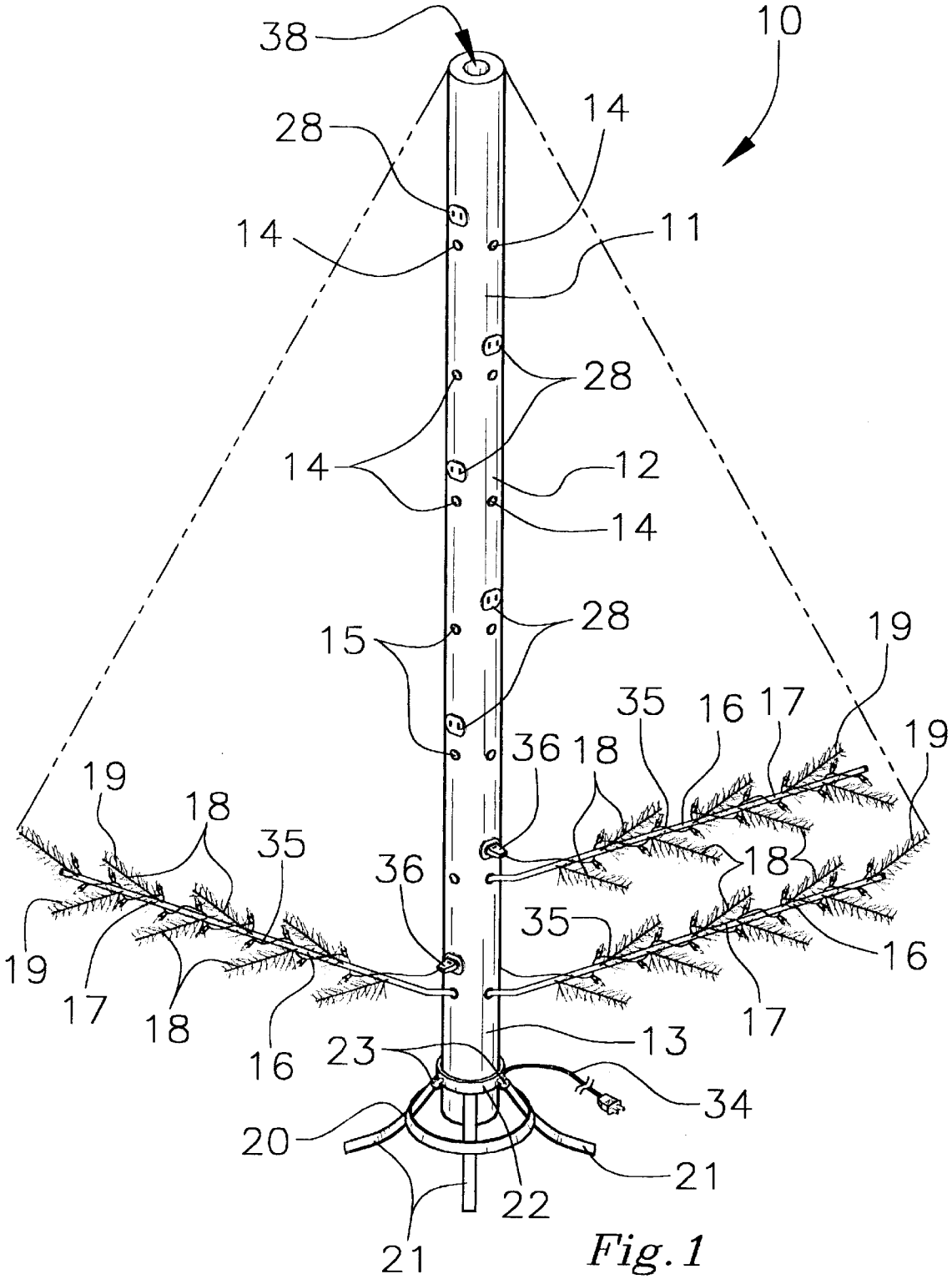
FIG. 1 is a perspective view of a new artificial electric christmas tree according to the present invention.
Figure 2:
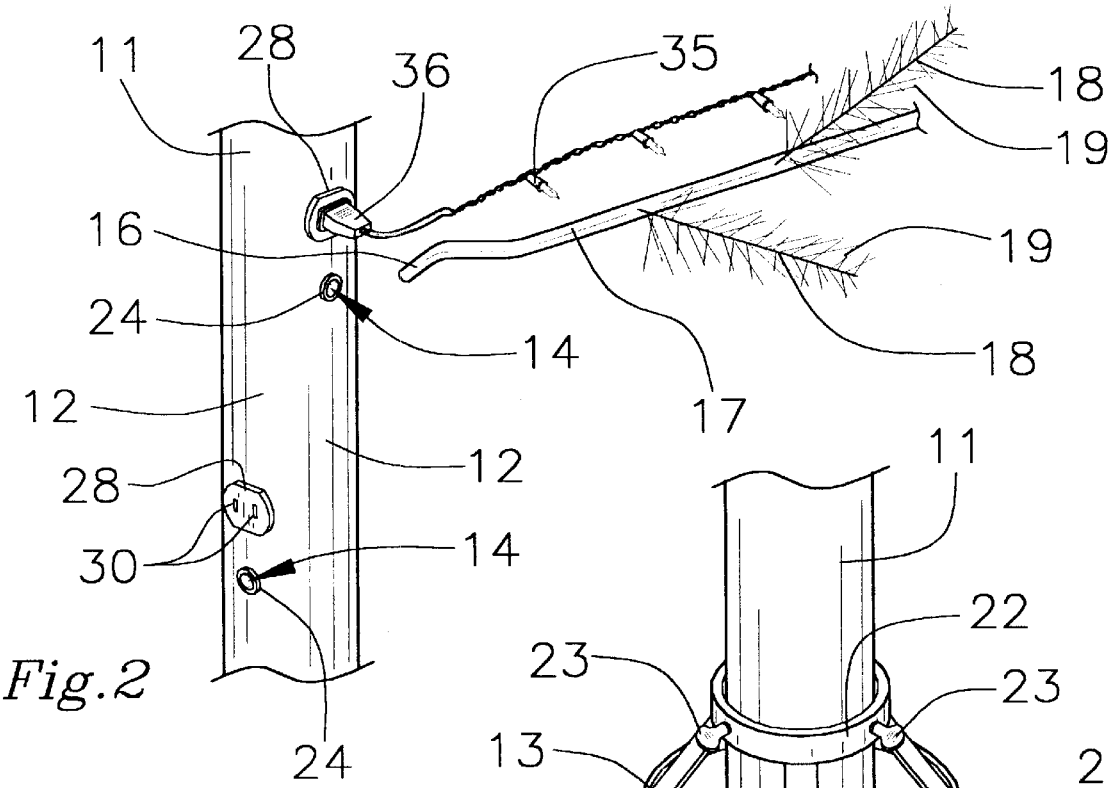
FIG. 2 is a detailed partial perspective view of the tree-like trunk and one of the branch-like members of the present invention.
Figure 4:
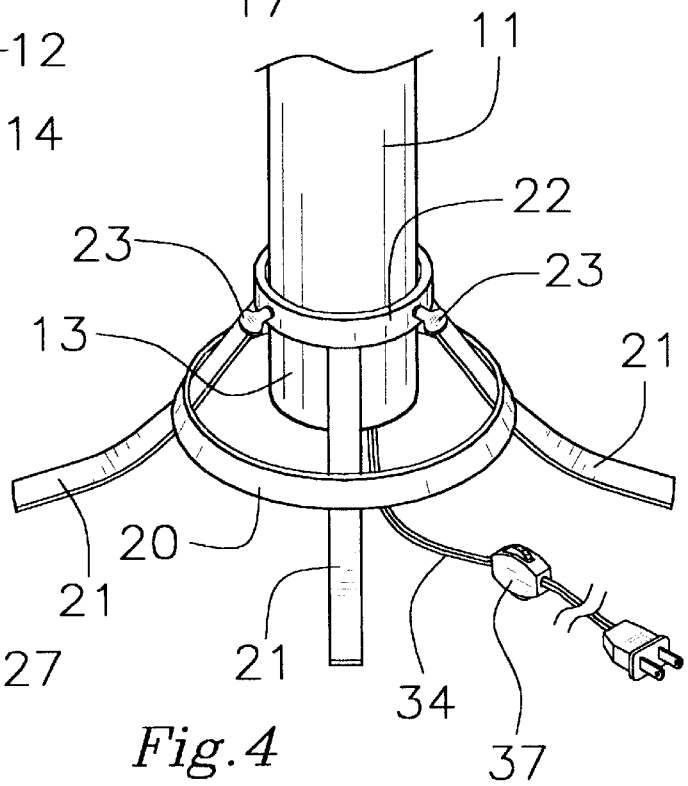
FIG. 4 is a detailed perspective view of the bottom of the tree-like trunk and the tree stand of the present invention.
Figure 3:
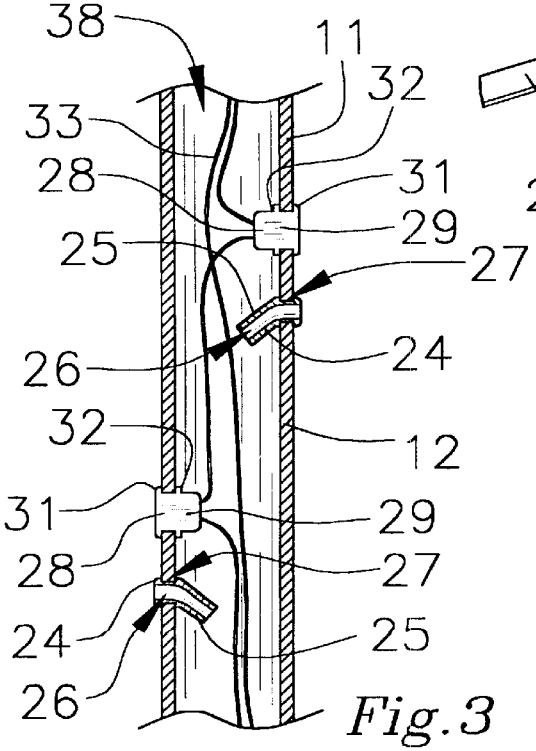
FIG. 3 is a partial cross-sectional view of the tree-like trunk of the present invention.

With reference now to the drawings, and in particular to FIGS. 1 through 4 thereof, a new artificial electric christmas tree embodying the principles and concepts of the present invention and generally designated by the reference numeral 10 will be described.

As best illustrated in FIGS. 1 through 4, the artificial electric christmas tree 10 generally comprises a tree-like trunk 11 being generally tubular and having a bore 38 extending therethrough and further having a plurality of holes 14 extending through a side wall 12 and along a length thereof with the holes 14 including rows 15 of the holes 14 with each row 15 including some of the holes 14 which are spaced about a circumference of the tree-like trunk 11 and with the rows 15 being spaced along a length of the tree-like trunk 11. The artificial electric Christmas tree 10 also includes a tree stand 20 having a support member 22, a plurality of legs 21 securely and conventionally depending therefrom for supporting the tree-like trunk 11, and fasteners 23 for securing the tree-like trunk 11 to the tree stand 20 and being threaded through the support member 22.

A plurality of electrical outlet members 28 are spacedly disposed in the side wall 12 of the tree-like trunk 11 and are conventionally connected to wires 33. Each of the electrical outlet members 28 includes a housing 29 having male prong-receiving slots 30 extending therein and also having a pair of annular flanges 31,32 being spaced apart and securely and conventionally extending about an exterior of the housing 29 and being adapted to receive a portion of the side wall 12 of the tree-like trunk 11 therebetween for securely retaining the housing 29 within the side wall 12 of the tree-like trunk 11. The artificial electric Christmas tree 10 further includes a plurality of branch-like members 16 each having an end which is securely and removably extended in a respective hole 14 of the tree-like trunk 11. Each of the branch-like members 16 includes a main branch 17 having the end which is securely and removably extended in a respective hole 14 and also including a plurality of secondary branches 18 being securely and conventionally attached to the main branch 17 and extending outwardly therefrom. Each of the secondary branches 18 includes needle-like members 19 being securely and conventionally attached thereto and extending outwardly therefrom. In addition, the artificial electric Christmas tree 10 includes a plurality of branch retaining members 24 each being securely and conventionally disposed in a respective hole 14 and being adapted to receive and retain a respective branch-like member 16. Each of the branch retaining members 24 includes a curved tubular member 25 having a bore 26 extending therethrough and having a groove 27 extending in an exterior and about a circumference and near an end thereof with the groove 27 being adapted to receive an edge of a respective hole 14 for securely fastening the tubular member 25 to the tree-like trunk 11. Each of the tubular members 25 of the branch retaining members 24 is extended downwardly toward a bottom 13 of the tree-like trunk 11 to effectively retain a respective branch-like member 24 therein. Strings of light-emitting members 35 are supported upon and wound about the branch-like members 16. Each of the strings of light-emitting members 35 includes a plug 36 securely and conventionally attached at an end thereof and having male prongs which are adapted to extend into the mail prong-receiving slots 30 of a respective electrical outlet member 28. A power cord 34 having a on/off switch 37 conventionally disposed inline thereof is securely and conventionally connected to the wires 33 of the electrical outlet members 28 for providing electrical current to the electrical outlet members 28.

In use, the user sets up the artificial electric Christmas tree 10 by placing the tree stand 20 upon a level surface and then by securing the tree-like trunk 11 to the support member 22 of the tree stand 20 using the fasteners 23. Next, the user extends the branch-like members 16 in the holes 14 and the branch retaining members 24 and winds the strings of light-emitting members 35 about the branch-like members 16 and plugs the male prongs into the electrical outlet members 28 and plugs the power cord 34 into a power source which energizes the light-emitting members 35.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An artificial electric Christmas tree comprising a tree-like trunk being generally tubular and having a bore extending therethrough and further having a plurality of holes extending through a side wall and along a length thereof;

a tree stand having a support member, a plurality of legs depending therefrom for supporting said tree-like trunk, and fasteners threaded through said support member for securing said tree-like trunk to said tree stand;

a plurality of electrical outlet members being spacedly disposed in said side wall of said tree-like trunk and being connected to wires;

a plurality of branch-like members each including a main branch having an end which is securely and removably positionable in a respective one of said holes of said tree-like trunk, said end of each of said main branches having a generally curved configuration;

a plurality of branch retaining members each being securely disposed in a respective one of said holes and being adapted to receive and retain a respective said branch-like member, wherein each of said branch retaining members includes a curved tubular member having a bore extending therethrough, said curved tubular member having a shape being substantially complementary to said curved configuration of said end of said main branch such that each of said main branches are restricted from rotating with respect to said respective retaining member and said tree-like trunk when said end is positioned in said respective retaining member;

strings of light-emitting members each being supported upon a respective said branch-like member; and a power cord having a on/off switch conventionally disposed inline thereof and being connected to said wires of said electrical outlet members for supply electrical current to said electrical outlet members.

2. An artificial electric Christmas tree as described in claim 1, wherein said holes include rows of said holes with each said row including some of said holes which are spaced about a circumference of said tree-like trunk, said rows being spaced along a length of said tree-like trunk.

3. An artificial electric Christmas tree as described in claim 1, wherein each of said electrical outlet members includes a housing having male prong-receiving slots extending therein and also having a pair of annular flanges being spaced apart and integrally extending about an exterior of said housing and being adapted to receive a portion of said side wall of said tree-like trunk therebetween for securely retaining said housing within said side wall of said tree-like trunk.

4. An artificial electric Christmas tree as described in claim 1, wherein each of said branch-like members includes a plurality of secondary branches being attached to said main branch and extending outwardly therefrom, each of said secondary branches including needle-like member securely attached thereto and extending outwardly therefrom.

5. An artificial electric Christmas tree as described in claim 1, wherein each of said branch retaining members includes a groove extending in an exterior and about a circumference and near an end thereof, said groove being adapted to receive an edge of a respective said hole for securely fastening said tubular member to said tree-like trunk.

6. An artificial electric Christmas tree as described in claim 3, wherein each of said strings of light-emitting members includes a plug securely attached at an end thereof and having male prongs which are adapted to extend into said mail prong-receiving slots of a respective said electrical outlet member.

7. An artificial electric Christmas tree as described in claim 1, wherein each of said tubular members of said branch retaining members is extended downwardly toward a bottom of said tree-like trunk to effectively retain a respective said branch-like member therein.

8. An artificial electric Christmas tree comprising a tree-like trunk being generally tubular and having a bore extending therethrough and further having a plurality of holes extending through a side wall and along a length thereof, said holes including rows of said holes with each said row including some of said holes which are spaced about a circumference of said tree-like trunk, said rows being spaced along a length of said tree-like trunk;

a tree stand having a support member, a plurality of legs depending therefrom for supporting said tree-like trunk, and fasteners being threaded through said support member for securing said tree-like trunk to said tree stand;

a plurality of electrical outlet members being spacedly disposed in said side wall of said tree-like trunk and being connected to wires, each of said electrical outlet members including a housing having male prong-receiving slots extending therein and also having a pair of annular flanges being spaced apart and integrally extending about an exterior of said housing and being adapted to receive a portion of said side wall of said tree-like trunk therebetween for securely retaining said housing within said side wall of said tree-like trunk;

a plurality of branch-like members each including a main branch having an end which is securely and removably positionable in a respective one of said holes of said tree-like trunk, said end of each of said main branches having a generally curved configuration, and also including a plurality of secondary branches being attached to said main branch and extending outwardly therefrom, each of said secondary branches including needle-like member securely attached thereto and extending outwardly therefrom;

wherein each of said branch-like members has a first portion with a substantially linear configuration along a primary axis, a second portion extending away from said primary axis, and a third portion extending from said second portion back toward said primary axis;

a plurality of branch retaining members each being securely disposed in a respective one of said holes and being adapted to receive and retain a respective said branch-like member, wherein each of said branch retaining members includes a curved tubular member having a bore extending therethrough, said curved tubular member having a shape being substantially complementary to said curved configuration of said end of said main branch such that each of said main branches are restricted from rotating with respect to said respective retaining member and said tree-like trunk when said end is positioned in said respective retaining member, each of said retaining members having a groove extending in an exterior and about a circumference and near an end thereof, said groove being adapted to receive an edge of a respective said hole for securely fastening said tubular member to said tree-like trunk, each of said tubular members of said branch retaining members being extended downwardly toward a bottom of said tree-like trunk to effectively retain a respective said branch-like member therein;

strings of light-emitting members each being supported upon a respective said branch-like member, each of said strings of light-emitting members including a plug securely attached at an end thereof and having male prongs which are adapted to extend into said mail prong-receiving slots of a respective said electrical outlet member; and a power cord having a on/off switch conventionally disposed inline thereof and being connected to said wires of said electrical outlet members for supply electrical current to said electrical outlet members.

9. An artificial electric Christmas tree as described in claim 1, wherein each of said branch-like members has a first portion with a substantially linear configuration along a primary axis, a second portion extending away from said primary axis, and a third portion extending from said second portion back toward said primary axis.

* * * * *